US006032389A

United States Patent [19]

Perry et al.

[11] Patent Number: 6,032,389

[45] Date of Patent: Mar. 7, 2000

[54] EARTH MOVER WITH LEVELING DEVICE OR FIXED CUTTING EDGE EARTH MOVER

[75] Inventors: Gary D. Perry; Steve Williams, both of Lubbock, Tex.

[73] Assignee: Eagle-Picher Industries, Inc., Cincinnati, Ohio

[21] Appl. No.: 09/078,373

[22] Filed: May 13, 1998

[51] Int. Cl.[7] ..... E02F 3/64

[52] U.S. Cl. ..... 37/431; 37/427; 37/416; 37/422

[58] Field of Search ..... 37/416, 417, 418, 37/419, 421, 427, 431, 304, 901, 422; 172/799.5, 135, 684.5

[56] References Cited

U.S. PATENT DOCUMENTS

| | | | |
|---|---|---|---|
| 2,064,023 | 12/1936 | Maloon | 37/418 |
| 2,305,481 | 12/1942 | Le Bleu | 37/418 |
| 2,386,192 | 10/1945 | Brimhall | 37/417 |
| 2,455,160 | 11/1948 | Burrow | 37/419 X |
| 2,490,310 | 12/1949 | Le Tourneau | 37/418 |
| 3,296,715 | 1/1967 | Jass et al. | 37/418 X |
| 3,314,176 | 4/1967 | Jones | 37/417 X |
| 3,431,663 | 3/1969 | Eiger | 37/431 |
| 3,483,640 | 12/1969 | Anderson et al. | 37/418 X |
| 3,872,612 | 3/1975 | Gee | 37/431 |

*Primary Examiner*—Victor Batson
*Attorney, Agent, or Firm*—Wood, Herron & Evans, LLP

[57] ABSTRACT

An earth mover includes a fixed scraper blade and a moveable floor section. The moveable floor section can be pulled rearwardly to provide an opening between the fixed scraper blade and the forward edge of the floor section. The floor section is mounted on tracks which run on the exterior of the sidewalls of the bowl. The forward portion of the tracks are angled upwardly which keeps the floor tight against the bottom of the bowl. When the floor is in the open position, it allows the floor to extend downwardly below the thick scraper blade. This allows the forward edge or blade of the floor section to act as a leveler as the dirt is being unloaded from the earth mover.

7 Claims, 3 Drawing Sheets

EARTH MOVER WITH LEVELING DEVICE OR FIXED CUTTING EDGE EARTH MOVER

BACKGROUND OF THE INVENTION

Earth movers are employed to move relatively large volumes of earth. There are different types of these devices. There is a push-pull-type device which has a power driven front and rear section which move a blade across the ground and force dirt and soil into the bowl of the earth mover.

Another type of earth mover is the scraper/elevator-type. This device is typically pulled from the front and has a scraper blade that contacts and lifts dirt pushing it into the rear of the bowl. When it is desirable to unload the earth mover, the floor of the bowl can be partially opened and a pusher forces the dirt forwardly. Many of these devices have a forward most fixed cutting edge which is welded to the sidewalls of the bowl. The floor is simply pulled straight back and the dirt then falls from the bowl of the earth mover. The earth mover simply moves and runs over the dirt as it is deposited. There is no leveling action. Thus, in order to subsequently level the deposited dirt, a bulldozer or grader is required. This, of course, increases the expense of leveling the dirt. In certain applications this is not a problem. In other applications, this can be an unwanted additional expense.

SUMMARY OF THE INVENTION

The present invention is premised upon the realization that an earth mover having a fixed cutting edge can be designed to provide leveling or strike-off capability during the load-ejection cycle.

More particularly, the present invention is premised upon the realization that a secondary blade can be fixed to the movable floor section of a fixed cutting edge earth mover or scraper and wherein the floor of the earth mover instead of moving straight back, moves back and downwardly so that the forward edge of the moveable floor section extends below the bowl of the earth mover. This provides a leveling or strike-off capability for the earth mover allowing the moveable floor section to act as a leveling mechanism for the earth mover.

The objects and advantages to the present invention will be further appreciated in light of the following detailed descriptions and drawings in which:

DETAILED DESCRIPTION

Figure 1:
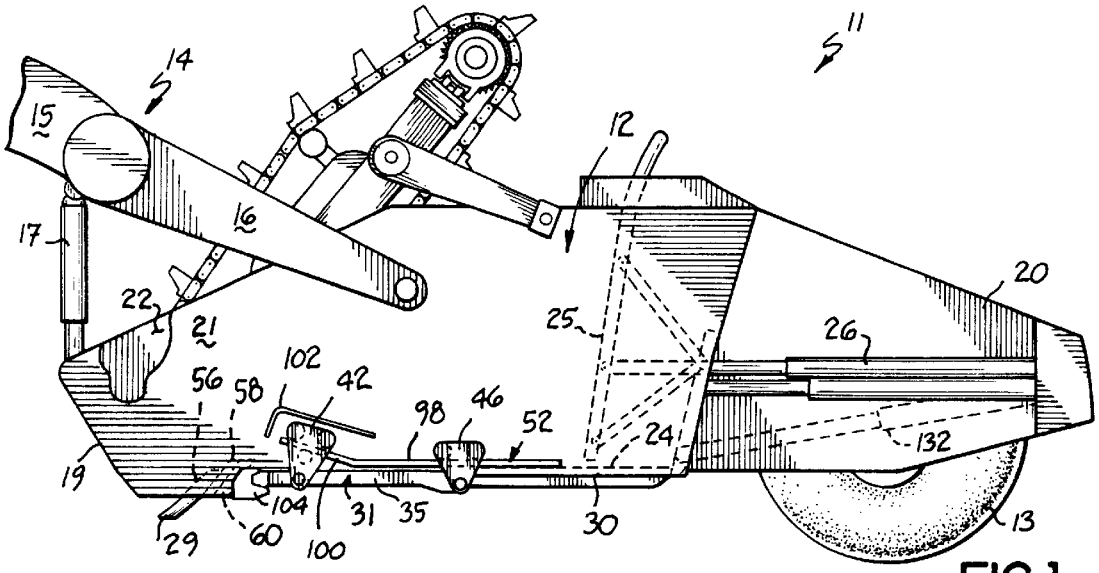
FIG. 1 is a side view broken away of an earth mover according to the present invention.
Figure 2:
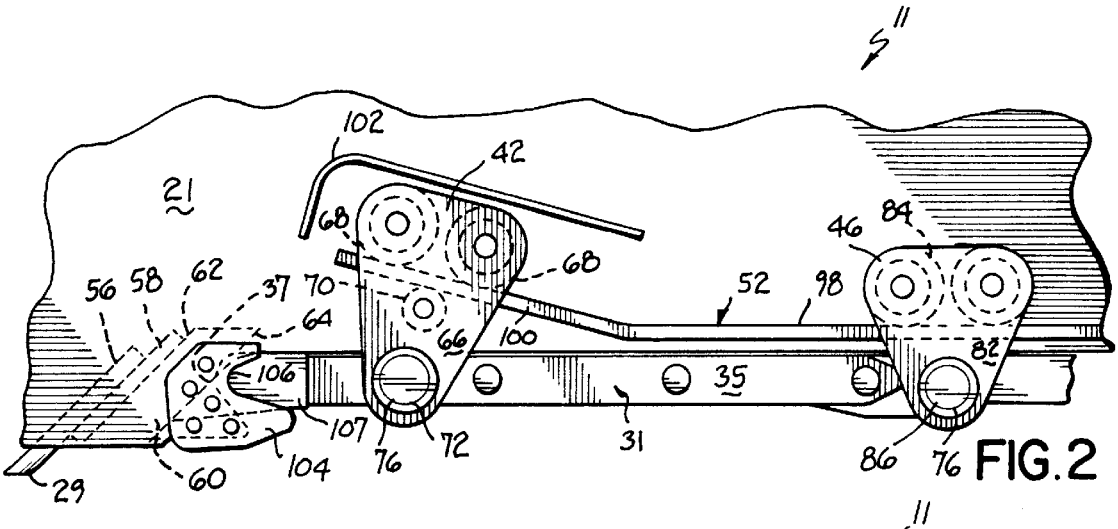
FIG. 2 is an enlarged side view broken away of the floor mechanism of the present invention.

As shown in FIG. 1, there is an earth mover 11 which includes a bowl 12 which is supported at a rear end by tires 13 and the front end by a draft frame 14. The draft frame 14 includes a gooseneck 15 shown partially broken away which attaches to right and left draft arms 16 (only left arm shown).

Bowl 12 can be raised and lowered by a pair of hydraulic cylinders 17 (only left arm shown) acting on arm 16. This acts to adjust the front end of bowl 12. The gooseneck 15 is attached to a tractor.

The bowl 12 includes a forward portion 19 and a rear portion 20 along with left sidewall 21 and right sidewall 22. Extending between the sidewalls is a floor 24. An ejector 25 is mounted in the rear 20 of bowl 12 which is moved forwardly or rearwardly by ejector cylinder 26.

The forward portion of bowl 19 includes a forward most fixed scraper blade 29 which extends between left and right sides 21 and 22. Likewise, there is a rear fixed floor section 30 and a forward moveable floor section 31 between blade 29 and fixed floor section 30. The moveable floor section 31 has a front member 33, a rear portion 34, a left side 35 and a second or right side 36. The front edge of floor section 31 is a blade 37. Attached to the rear section 34 is a yoke or bracket 39. Mounted on the sides 35 and 36 of floor section 31 are forward supports 42 and 44 and rear supports 46 and 48 respectively. These run on tracks 52 and 54 which are welded to the outside surface of the left and right sides 21 and 22.

Forward of the front edge 33 of the floor section 31 is the fixed scraper blade section 29. This includes an angled blade 56 which is bolted to a blade bracket 58 which is in turn welded to a support 60. The support 60 includes a front angled surface 62 and a rear angled surface 64. As will be shown later, the front of the floor section 31 mates with this rear angled section 64 when the floor section 31 is in a closed position.

The floor section 31 itself is mounted on the front and rear support 42, 44, 46 and 48. The front supports 42 and 44 are mirror images of each other and only left support 42 is discussed in detail. This support 42 includes a generally triangular bracket 66. Mounted to the bracket are top rollers 68 and a bottom roller 70. Below the bottom roller 70 is a bearing 72.

The support 42 rides on track 52 with the track running between top rollers 68 and bottom roller 70. The floor section 31 is mounted to the bracket with a mounting post or hub 74 which is welded to the floor section and extends beyond the left edge of the floor section into the bearing 72. A retaining ring 76 is fastened to post 74 holding it to the bracket 42 and allowing it to pivot relative to the floor section 31 during movement.

Again rear brackets 46 and 48 are mirror images of each other and only bracket 46 is described herein in detail. Bracket 46 again includes the bracket section 82 which has two upper rollers 84 and a lower bearing 86. A post 88 which extends from brackets 90 welded to the rear edge 92 of floor section 31 extends beyond the sidewall 22 of the bowl 12 and into the bearing 86. It is held within the bearing 86 by a retaining ring 76 similar to bracket 42, which is bolted to the post 88.

Tracks 52 and 54 again are mirror images of each other and only left side track 54 is described herein. This track has a linear rear section 98 and a forward angled section 100. Above the angled section 100 is a guard 102.

Brackets 104 are mounted to sidewalls 21 and 22. These brackets include an arcuate slot 106. The front portion 33 of floor section 31 include complementary plates 107 bolted to the floor section which mate with the arcuate slot 106 and bracket 104 when the floor is in a closed position.

The rear 34 of floor section 31 is connected to yoke 39 at pivotal mounts 110. The yoke includes the bracket portion 112 and a stepped portion 114 which allows the yoke to slide under the fixed floor portion 30. Rearward of this step portion is a cylinder bracket 116 which includes two sidearms 118 and 120. Mounted at each sidearm are rollers 122 and 124 which ride on a left and right track 126 and 128 which extends from a rearmost portion of the earth mover (not shown) up to the rear edge 130 of fixed floor section 30.

In operation the moveable floor section 31 will initially be in a forward most position, i.e., the forward edge of floor section 31 will butt up against the rear angled section of the blade support. The forward brackets 42 and 44 will be supported on the forward most edge of the track on the angled portion 100 which will hold the floor section 31 against the bottom edge 130 of the bowl. The plates 107 of floor section 31 will nest in the arcuate slots 106 of brackets 104. The scraper will then be operated with the scraper blade loosening dirt and the pusher blades forcing the dirt into the bowl.

Figure 3:
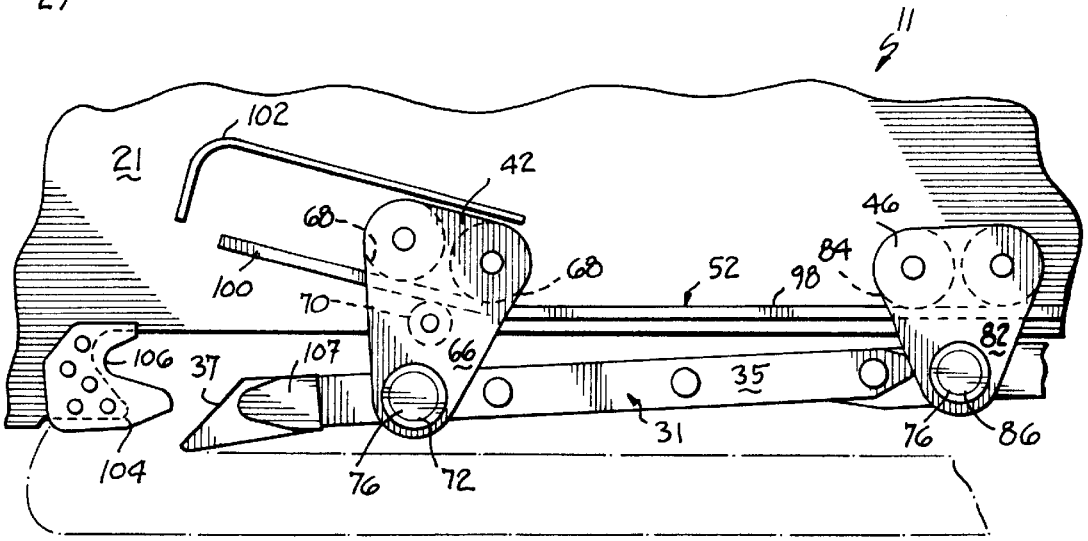
FIG. 3 is a side view similar to FIG. 2 showing the floor section in retracted position.
Figure 4:
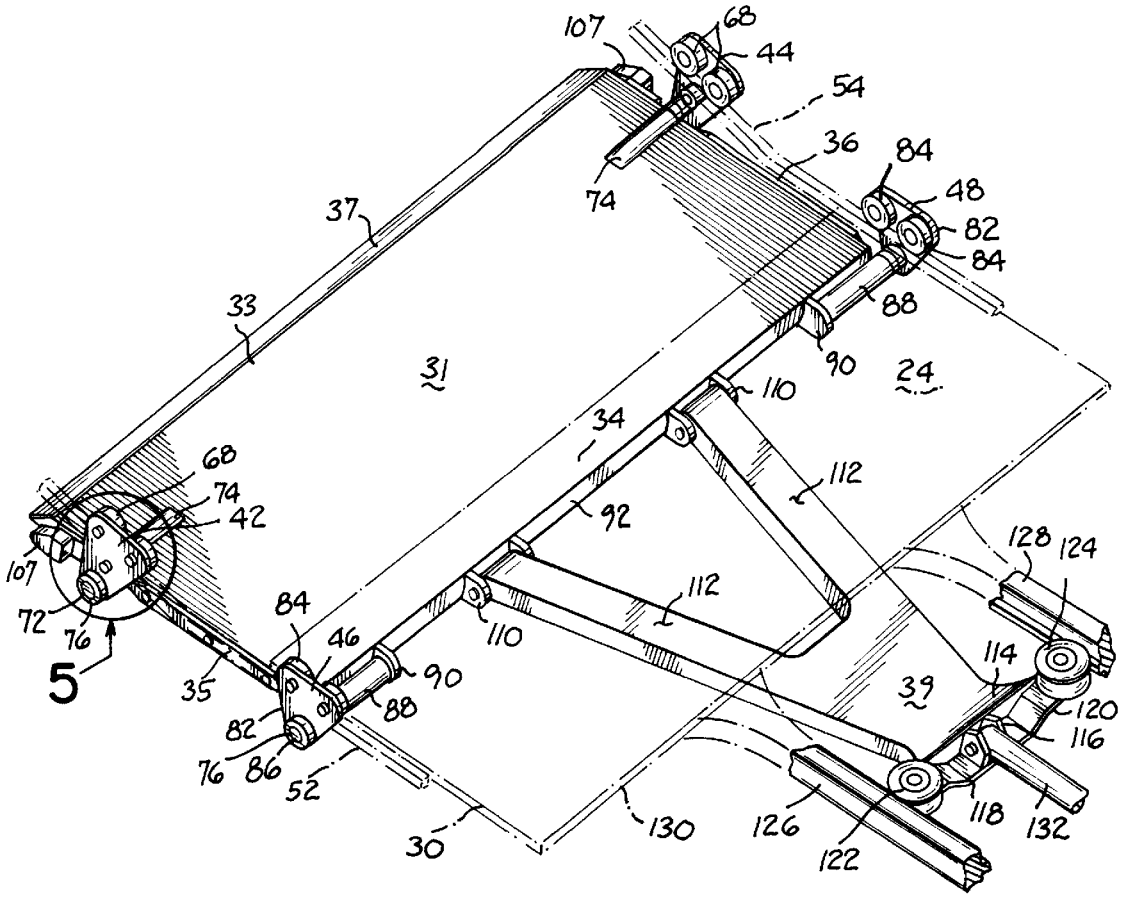
FIG. 4 is a perspective view of the floor section of the present invention.
Figure 5:
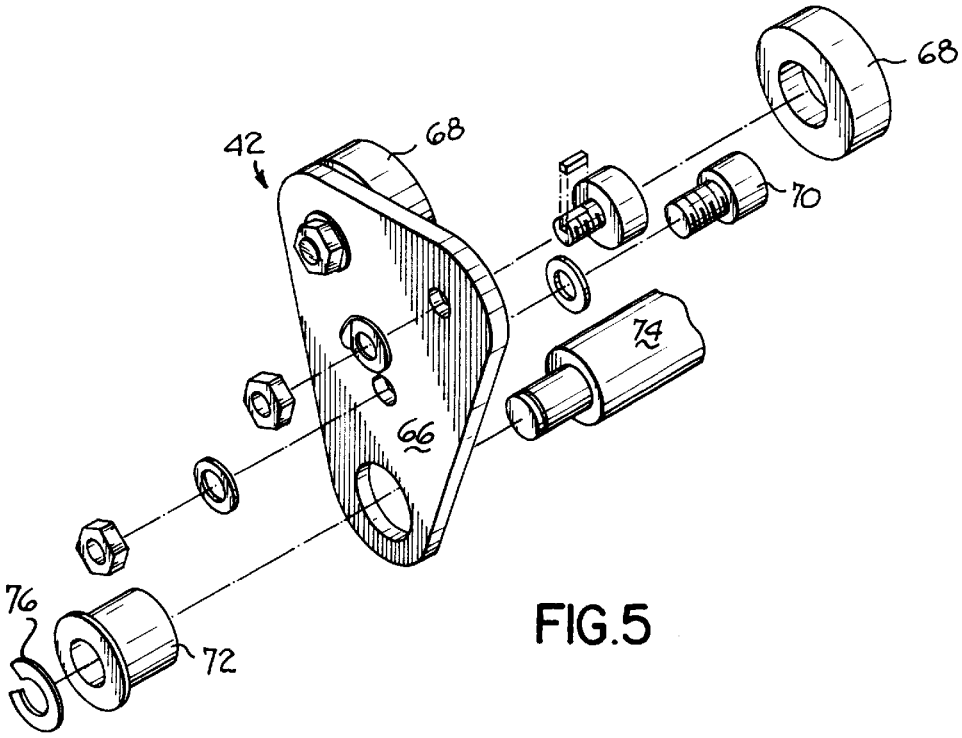
FIG. 5 is a disassemble perspective view of the encircled area 5.
Figure 6:
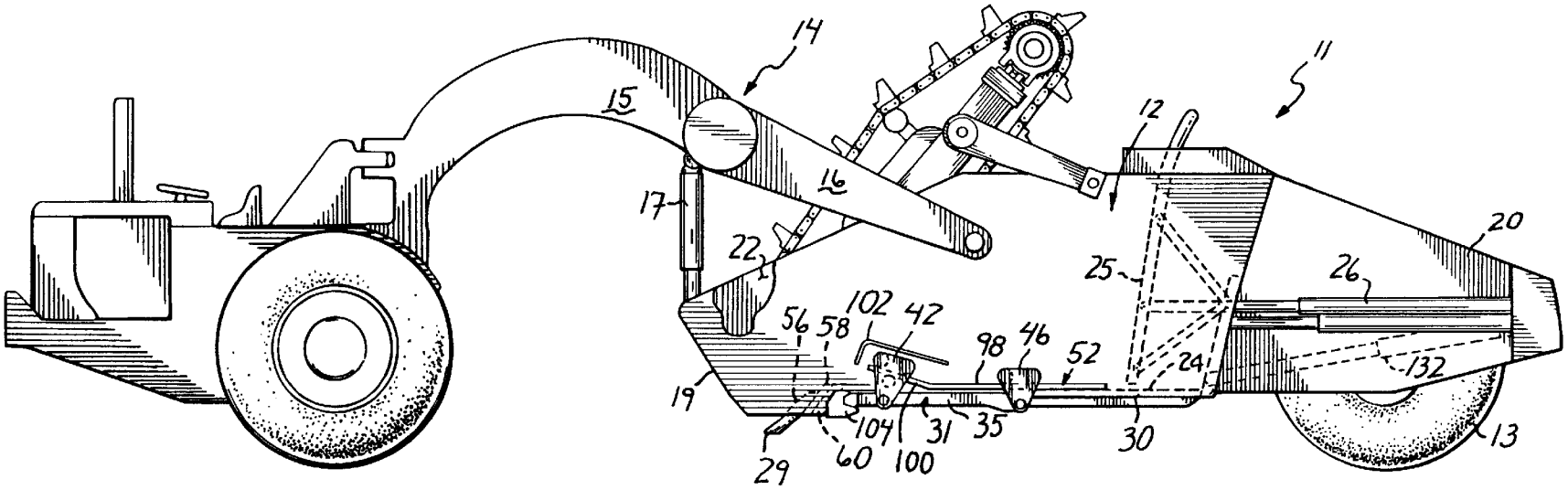
FIG. 6 is a side view of an earth mover according to the present invention.

When it is desirable to unload this dirt, the bowl can be raised using the hydraulic arm. The pusher 25 will then be activated to push dirt forwardly and the hydraulic arm 132 will be activated to pull the yoke rearwardly in turn pulling the floor section 31 rearwardly which will separate the blade section 37 of the floor section 31 from the fixed angled blade support 60. The brackets 42, 44, 46 and 48 will ride on tracks 52 and 54 and the forward brackets 42 and 44 will move down the angled portion 100 to the linear portion 98 of tracks 52 and 54 causing the floor section 31 to angle downwardly. This will create an opening between the fixed blade support and the forward edge of the floor section 31. The dirt will then fall out through this opening. As shown in FIG. 3, the blade portion 37 of the floor section 31 will level the dirt as the earth mover is pulled forwardly by the tractor. When the bowl is emptied, the hydraulic arm 132 will be activated forcing the yoke 39 forward and in turn forcing the floor section 31 forward. This will cause the forward brackets 42 and 44 to ride along the track 52 and up the angled portion 100 of the track. This will in turn pull the floor section 31 upwardly against the bottom edge 130 of the bowl 12 and cause the blade 37 of the floor section 31 to butt up against the rear edge 64 of the fixed blade support 60 closing the bowl and the earth mover will then be ready to be refilled.

This mechanism permits the earth mover of the present invention to perform the dual function of removing dirt and unloading this and leveling at the same time. This can either eliminate the need for bulldozers and grade levelers or at the very least significantly reduce the amount of work required by these other pieces of equipment. This provides significant efficiencies in terms of time and cost.

This, of course, has been a description of the present invention along with a preferred method of practicing the present invention. The invention itself, however, should be defined only by the appended claims wherein

We claim:

1. An earth mover comprising a tractor and a bowl, said bowl having a bottom floor and two sidewalls;

a fixed scraper blade extended between said sidewalls;

said floor having a fixed rear section and a forward section;

wherein said forward section of said floor is moveable from a closed position under said rear section to an open position;

said forward section of said floor further having a horizontal forward edge which abuts said fixed scraper blade when said floor is in a closed position wherein said horizontal forward edge is extended lower relative to said bowl when said floor is in an open position.

2. The earth mover claimed in claim 1 further comprising an ejector adapted to push contents of said bowl forwardly.

3. The earth mover claimed in claim 2 wherein said forward section of said floor is supported on a track by forward and rear brackets, said track having an upwardly extended forward portion and a lower rear portion wherein said forward brackets are longer than said rear brackets thereby causing said forward edge to extend below said bowl as said forward section is moved to an open position.

4. The earth mover claimed in claim 3 wherein said track runs on an exterior side of each of said sidewalls.

5. The earth mover claimed in claim 1 wherein said horizontal forward edge mates with a rear edge of said fixed scraper blade when said forward section of said floor is in a closed position.

6. The earth mover claimed in claim 1 wherein said sidewalls of said bowl include brackets having a slotted portion and wherein said floor includes a first and second distal plates at forward portions of said forward section of said floor wherein said plates mount in said slotted portions of said brackets respectively when said forward section of said floor is in said closed position.

7. An earth mover comprising a tractor and a bowl;

said bowl having a bottom floor and two sidewalls, a first and second track mounted on exterior sides of said sidewalls;

said tracks having a linear rear portion and an upwardly angled forward portion;

a fixed scraper blade extended from interior portions of said sidewalls and having a rear angled portion;

wherein said floor includes a fixed floor section and a moveable floor section, said moveable floor section is adapted to move from a closed position under said fixed floor section to an open position;

said moveable floor section having a forward most blade adapted to mate with a rear portion of said fixed scraper blade when said moveable floor section is in said closed position;

said moveable floor section supported by forward and rear lateral brackets riding on said first and second tracks;

wherein said scraper blade of said moveable floor section moves downwardly as said moveable floor section is moved from a closed to an open position and wherein said moveable floor pivots downwardly at said rear brackets as said moveable floor moves from a closed position to an open position.

* * * * *